United States Patent [19]

Kinnear

[11] Patent Number: 4,918,755

[45] **Date of Patent: * Apr. 24, 1990**

[54] DISPOSABLE GLOVE OR MITT FOR SELF-SERVICE GASOLINE AND FROZEN FOOD HANDLER

[76] Inventor: Duane W. Kinnear, R.D. #1, 11770 Ridge Rd., East Springfield, Pa. 16411

[ * ] Notice: The portion of the term of this patent subsequent to May 30, 2005 has been disclaimed.

[21] Appl. No.: 251,306

[22] Filed: Sep. 30, 1988

[51] Int. Cl.[5] ..... A41D 19/00

[52] U.S. Cl. ..... 2/161 R; 2/159; 2/167

[58] Field of Search ..... 2/161 R, 167, 159; 428/159, 166, 178; 206/522, 521, 523, 594

[56] References Cited

U.S. PATENT DOCUMENTS

| | | | |
|---|---|---|---|
| 3,235,881 | 2/1966 | Chrisholm | 2/167 |
| 4,745,635 | 5/1988 | Kinnear | 2/161 R |

FOREIGN PATENT DOCUMENTS

| | | | |
|---|---|---|---|
| 2273728 | 1/1976 | France | 206/521 |
| 2415943 | 9/1979 | France | 206/522 |

*Primary Examiner*—Werner H. Schroeder
*Assistant Examiner*—Sara M. Current
*Attorney, Agent, or Firm*—Ralph Hammar

[57] ABSTRACT

A glove made of a sheet of foamed plastic bubbles of random sizes filled with air with the largest bubbles being of diameter much less than finger width which provides a cushioned gripping and thermal insulation useful im pumping self-service gasoline and handling frozen foods.

3 Claims, 1 Drawing Sheet

DISPOSABLE GLOVE OR MITT FOR SELF-SERVICE GASOLINE AND FROZEN FOOD HANDLER

This application is an improvement on applicant's Pat. No. 4,745,635, dated May 24, 1988.

This invention is a glove or mitt to be worn while pumping self-service gasoline which provides good gripping surface for the cold metal parts, insulates the hands from the metal parts and prevents contact with gasoline which has an objectionable odor.

The glove is also useful for handling frozen foods.

In the prior art, gloves or mitts have been made in which two identical sheets of plastic film placed one on top of the other and heat sealed together at peripheral edges. If the plastic sheets have surfaces which are perfectly smooth and flat, difficulty has been experienced in putting the gloves on because the adjacent surfaces tend to cling together.

In accordance with the present invention, at least one of the palm or back sides of the glove or mitt is a commercially available closed cell foam plastic sold under the trademark "Jiffy Pak" consisting essentially of a sheet of random sized load carrying plastic bubbles of trapped air.

Figure 1:
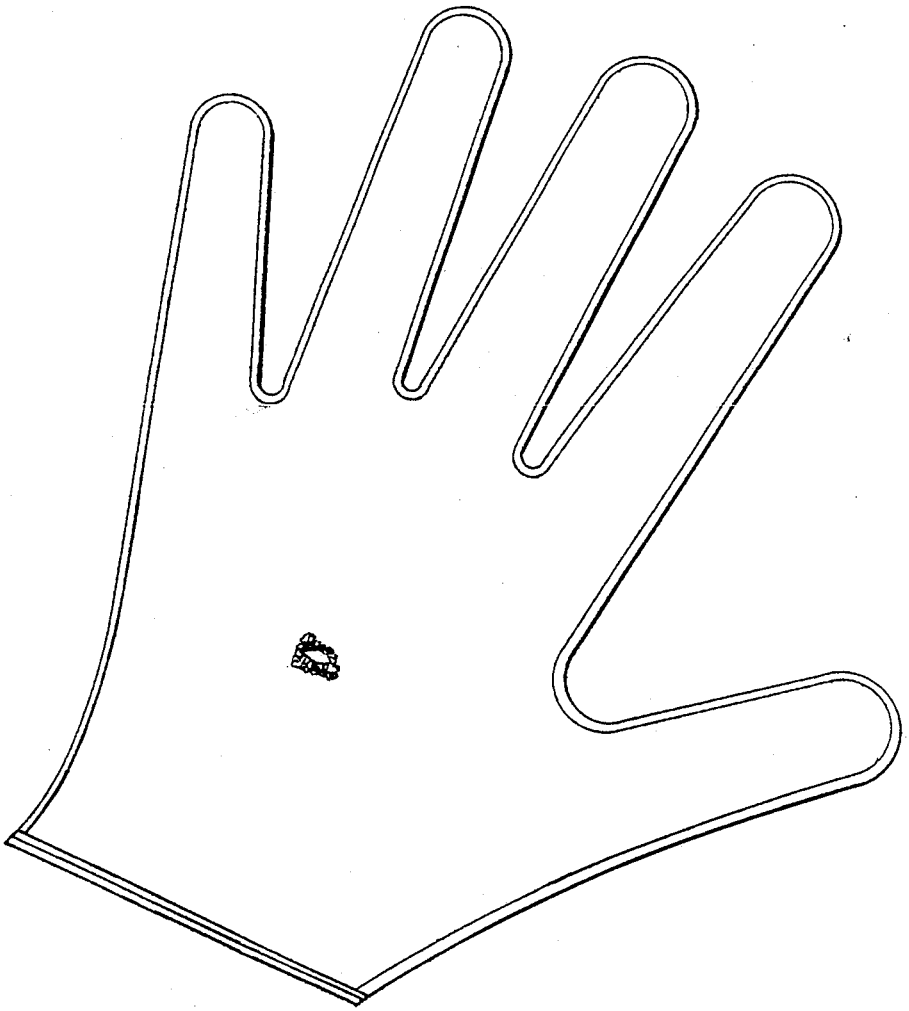
FIG. 1 is a view of a disposable glove.
Figure 2:
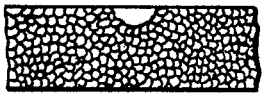
FIG. 2 is an enlarged fragmentary sectional view of the foam plastic sheet.

FIG. 1 shows the invention applied to a common glove shape for self-service gasoline but obviously any other shape could be used. Both the front and back sides of the glove (palm and back) are made from a sheet of closed cell foamed bubbles of polyethylene or other tough flexible plastic heat sealed together at peripheral edges. The bubbles are filled with air. The bubbles are of random sizes, the largest being of diameter much smaller than the width of a finger and typically about the thickness of the sheet which range in size from about 1/16 to ⅛ of an inch. The larger bubbles are flattened at the top and/or bottom to conform with the sheet forming apparatus. The medium sized and smaller bubbles are nestled together to fill the spaces between the larger bubbles and the spaces between the top and bottom surfaces of the sheet.

The resultant surfaces, while soft and smooth feeling, are not planar or flat.

The bubbles of the sheet do not interfere with heat sealing. The heat sealing is between two sheets of plastic, at least one of which is closed cell foamed bubbles. Some of the bubbles which fall along the line of the seal may be broken but the cushioning or heat insulation properties are not materially affected.

Since the glvoe may be worn on either hand, it is not necessary to buy a pair of gloves (right and left).

A tougher version of the glove may be made using a laminate sheet of polyethylene foam and thin film of tough plastic. The polyethylene foam would be on the inside of the glove and the film of plastic woulde be on the outside of the glove.

The glove would provide cold weather protection for emergency medical personnel from Aids victims.

U.S. Pat. No. 4,084,265 is directed to the problem of preventing sticking together films of plastic and does not contemplate a sheet of plastic consisting of distributed bubbles of randome sizes and filled with trapped air and nestled together between the inner and outer surfaces and the upper and lower surfaces of the sheet.

The glove may be made from polyethylene or other tough flexible plastic.

All forms of the glove are inexpensive to manufacture. The gloves are made from low cost sheets which may be assembled by heat sealing at the peripheral edges.

I claim:

1. A glove or mitt to be worn for self-service gasoline or for handling frozen food or for protecting emergency medical personnel, having a palm side of a flexible sheet of closed cell foamed plastic bubbles, the bubbles being of random sizes with the largest bubbles being of diameter about the thickness of the sheet and the medium sized and smaller bubbles being nestled together to fill the spaces between the larger bubbles and between the upper and lower surfaces of the sheet, and the bubbles being filled with air or other gas, which provides a cushioned gripping surface and thermal insulation for pumping gasoline and for handling frozen foods and for providing cold weather protection for emergency medical personnel.

2. The structure of claim 1 in which the palm and back sides are of said flexible closed cell foamed sheet material heat sealed together at peripheral edges.

3. The structure of claim 1 in which the toughness of the glove is increased by laminating a thin film of tough plastic to the outer surface of the sheet.

* * * * *